US008058954B2

(12) United States Patent
Yeates

(10) Patent No.: US 8,058,954 B2
(45) Date of Patent: Nov. 15, 2011

(54) TRANSMISSION LINE WITH A CROSS-HATCHED GROUND PLANE THAT IS EITHER FILLED WITH CONDUCTIVE PAINT OR COVERED BY A CONDUCTIVE FOIL

(75) Inventor: Kyle H. Yeates, Palo Alto, CA (US)

(73) Assignee: Apple Inc., Cupertino, CA (US)

( * ) Notice: Subject to any disclaimer, the term of this patent is extended or adjusted under 35 U.S.C. 154(b) by 148 days.

(21) Appl. No.: 12/398,985

(22) Filed: Mar. 5, 2009

(65) Prior Publication Data

US 2010/0225424 A1 Sep. 9, 2010

(51) Int. Cl.
*H01P 3/08* (2006.01)

(52) U.S. Cl. ..... 333/238; 333/246; 333/1

(58) Field of Classification Search ..... 333/238, 333/246, 1

See application file for complete search history.

(56) References Cited

U.S. PATENT DOCUMENTS

| | | | | |
|---|---|---|---|---|
| 4,644,092 | A * | 2/1987 | Gentry | 174/36 |
| 5,334,800 | A * | 8/1994 | Kenney | 174/250 |
| 5,682,124 | A * | 10/1997 | Suski | 333/1 |
| 6,198,441 | B1 * | 3/2001 | Okabe et al. | 343/702 |
| 6,225,568 | B1 | 5/2001 | Lin et al. | |
| 6,372,996 | B2 | 4/2002 | Lin et al. | |
| 6,590,466 | B2 | 7/2003 | Lin et al. | |
| 6,885,549 | B2 * | 4/2005 | Thomason | 361/679.27 |
| 2002/0126951 | A1 | 9/2002 | Sutherland et al. | |

* cited by examiner

*Primary Examiner* — Benny Lee

(74) *Attorney, Agent, or Firm* — Treyz Law Group; David C. Kellogg; G. Victor Treyz

(57) ABSTRACT

Transmission lines for electronic devices such as microstrip and stripline transmission lines may be provided that include patterned conductive lines and a conductive paint in the patterned conductive lines. The transmission lines may include one or more planar ground conductors. The ground conductors may include conductive lines arranged in a crosshatch pattern with spaces between the conductive lines. The ground conductors may also include conductive paint in spaces within the crosshatched pattern. The ground conductors may form one or more ground planes for the transmission lines.

18 Claims, 7 Drawing Sheets

TRANSMISSION LINE WITH A CROSS-HATCHED GROUND PLANE THAT IS EITHER FILLED WITH CONDUCTIVE PAINT OR COVERED BY A CONDUCTIVE FOIL

BACKGROUND

This invention relates generally to transmission lines, and more particularly, to microstrip and stripline transmission lines for electronic devices. The transmission lines may be used as part of wireless communications circuitry in handheld electronic devices, as an example.

Handheld electronic devices are becoming increasingly popular. Examples of handheld devices include handheld computers, cellular telephones, media players, and hybrid devices that include the functionality of multiple devices of this type.

Due in part to their mobile nature, handheld electronic devices are often provided with wireless communications capabilities. Handheld electronic devices may use wireless communications to communicate with wireless base stations. For example, cellular telephones may communicate using cellular telephone bands at 850 MHz, 900 MHz, 1800 MHz, and 1900 MHz (e.g., the main Global System for Mobile Communications or GSM cellular telephone bands). Handheld electronic devices may also use other types of communications links. For example, handheld electronic devices may communicate using wireless networking technology bands such as the 2.4 GHz and 5 GHz band used in the WIFI® (IEEE 802.11) wireless networking technology and the 2.4 GHz band used in the BLUETOOTH® wireless networking technology. Communications are also possible in data service bands such as the 3G data communications band at 2170 MHz band (commonly referred to as UMTS or Universal Mobile Telecommunications System).

To satisfy consumer demand for small form factor wireless devices, manufacturers are continually striving to reduce the size of components that are used in these devices. At the same time, manufacturers are continually striving to maximize the performance of wireless communications circuitry and antennas. As one example, manufacturers have made attempts to route transmission lines such as microstrip and stripline transmission lines through the potentially complex geometry of small form factor products while maximizing the efficiency of the transmission lines.

When transmission lines are routed through complex geometry of small form factor products, manufacturers may desire to bend the transmission lines at sharp angles (e.g., a small bend radius may help minimize wastes space inside a small form factor housing). Because a typical transmission line includes relatively stiff ground planes formed from solid copper, it can be difficult or impossible to bend the rigid transmission line at all desired angles. Manufacturers have attempted to alleviate some of the problems of these rigid transmission lines by forming flexible transmission lines that have ground planes formed from cross-hatched lines of copper. The cross-hatched lines of copper, however, include gaps in the ground plane that lead to less effective grounding and a less efficient transmission line.

It would therefore be desirable to be able to provide improved transmission lines such as microstrip and stripline transmission lines for electronic devices.

SUMMARY OF THE INVENTION

In accordance with an embodiment of the present invention, transmission lines such as microstrip and stripline transmission lines for electronic devices are provided. The transmission lines may include signal lines and ground conductors.

The conductors in the microstrip and stripline transmission lines may be formed from patterned conductive lines with spaces between the conductive lines. The patterned conductive lines may be formed from copper, as an example. The conductors in the transmission lines may also include conductive paint. The conductive paint may be any suitable conductive paint such as a silver paint. If desired, a conductive film may be used in place of the conductive paint. For example, a thin film or sheet of silver may be placed over the patterned conductive lines. The thin film or sheet of silver may cover the spaces between the conductive lines as well as the conductive lines. As an example, the conductors may include conductive paint or conductive film in the spaces between the conductive lines. With another suitable arrangement, each conductor may include conductive paint or conductive film throughout the conductor (e.g., including between the spaces between the conductive lines as well as over the conductive lines). By forming conductors with patterned conductive lines and conductive paint or conductive film, the transmission lines may exhibit increased flexibility and conductivity (e.g., transmission efficiency) relative to conventional transmission lines.

Each microstrip transmission line may include a ground conductor that forms a ground plane and at least one signal line. Each stripline transmission line may include at least two ground conductors which may also be shorted together to form a single ground plane. With one suitable arrangement, the ground conductors may be shorted together by a suitable number of vias along the length of each microstrip transmission line. Each stripline transmission line may also include at least one signal line sandwiched between the ground conductors. In general, transmission lines may include any suitable number of signal conductors (e.g., the transmission lines may carry any suitable number of signals along parallel signal lines).

With one suitable arrangement, each signal line in some or all of the transmission lines may be formed from a single line of copper and one or more of the ground conductors may be formed from patterned conductive lines and conductive paint. If desired, any suitable number of the signal lines may be formed from patterned conductive lines and conductive paste, conductive paint, and/or conductive film.

The transmission lines of the present invention may be used as part of any suitable electronic device. For example, the transmission lines may be used as radio-frequency transmission lines coupled between radio-frequency transceivers and antennas in a wireless electronic device. The transmission lines may also be routed though complex geometry of a small form factor electronic device and may be bent at relatively sharp angles (e.g., the transmission lines may have bend radii such as 1.5 mm or less, 1.0 mm or less, 0.8 mm or less, 0.5 mm or less, etc.).

If desired, the signal and ground conductors in a transmission line may be formed from solid lines (e.g., solid lines of copper) along lengths of the transmission line that are not bent at relatively sharp angles. For example, if the transmission line for an electronic device does not need to be bent at a sharp angle along one or more particular lengths of the transmission line, those particular lengths of the transmission line may be formed with conductors formed from solid lines. With this type of arrangement, portions of the transmission line that are bent at sharp angles during manufacturing or in the assembled device may be selectively formed from patterned conductive lines with spaces and with conductive paint or conductive film to fill in the spaces.

Further features of the invention, its nature and various advantages will be more apparent from the accompanying drawings and the following detailed description of the preferred embodiments.

DETAILED DESCRIPTION OF THE INVENTION

Figure 1:
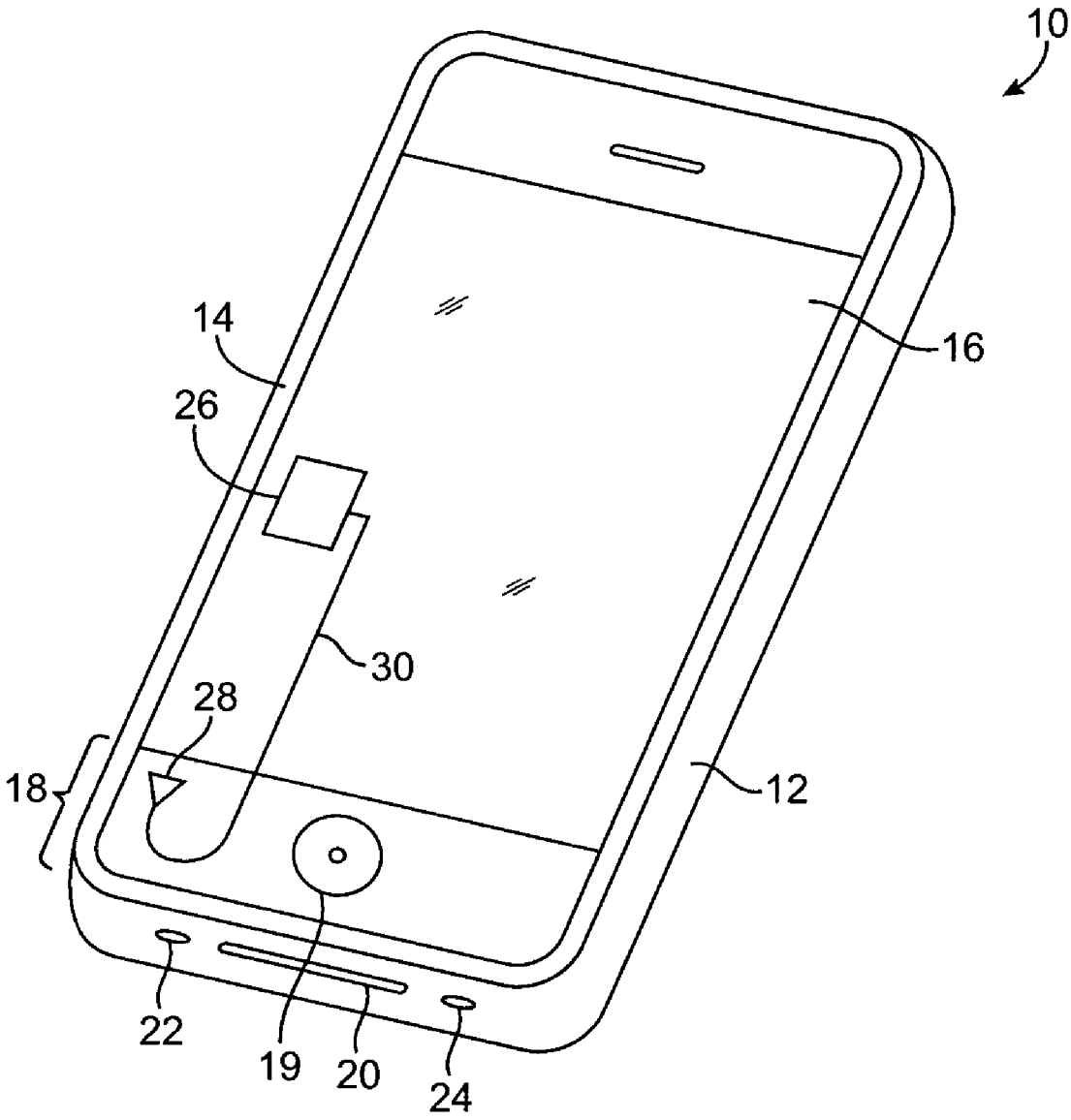
FIG. 1 is a perspective view of an illustrative handheld electronic device in accordance with an embodiment of the present invention.

The present invention relates generally to transmission lines and, more particularly, to microstrip and stripline transmission lines for electronic devices. The transmission lines may include trace lines (e.g., copper traces or other metal traces that form signal lines) and one or more ground conductors. The ground conductors may include conductive lines arranged in a pattern. There may be spaces in the pattern between the conductive lines. The spaces between the conductive lines may be filled with conductive paint such as a silver paint material. Materials such as silver paint have previously been used to fill copper-lined vias. A typical silver paint includes solvent and silver particles. When dried, the silver paint forms a conductor.

The ground conductor may be formed from a conductive structure such as a planar layer of metal with pattern of openings. The patterned metal in the ground conductor may be, for example, a pattern of crosshatched lines (e.g., a pattern of crosshatched copper lines). The conductive paint and crosshatched conductive lines may form one or more ground planes for the transmission lines. As one example, the transmission lines may be used as part of wireless electronic devices.

Conductors for transmission lines that are formed from solid metal structures can be inflexible if they are thick. By providing spaces between the solid metal structures, flexibility may be increased. Conductivity may be enhanced in this type of flexible structure by incorporating conductive paint. For example, conductive paint may be placed in the spaces between the solid metal structures. Conductive paint or conductive foil may also be used as an ancillary conductive layer that is placed over the solid metal structures with spaces (e.g., over the spaces and over the solid metal structures). Any suitable conductive foil such as aluminum foil or silver foil may be used.

Solid metal structures for forming transmission line conductors may be formed using techniques such as evaporation, sputtering, and electroplating. Conductive paints tend to be more flexible than solid metals because they are formed from thin layers of conductive particles rather than thick lines of solid metal. Initially, a conductive paint is a liquid solution including a solvent, conductive particles, and additional agents such as binders. Typical solvents include ethanol and acetone. Typical conductive particles include metals such as silver and platinum. Other solvents and conductive particles may be used if desired. After a liquid conductive paint has been applied to a transmission line, the solvent may be evaporated so that the conductive particles coalesce and form a good conductor. Conductive paints are sometimes referred to as conductive pastes or conductive inks.

The wireless electronic devices may be portable electronic devices such as laptop computers or small portable computers of the type that are sometimes referred to as ultraportables. Portable electronic devices may also be somewhat smaller devices. Examples of smaller portable electronic devices include wrist-watch devices, pendant devices, headphone and earpiece devices, and other wearable and miniature devices. With one suitable arrangement, which is sometimes described herein as an example, the portable electronic devices are handheld electronic devices.

The handheld devices may be, for example, cellular telephones, media players with wireless communications capabilities, handheld computers (also sometimes called personal digital assistants), remote controllers, global positioning system (GPS) devices, and handheld gaming devices. The handheld devices may also be hybrid devices that combine the functionality of multiple conventional devices. Examples of hybrid handheld devices include a cellular telephone that includes media player functionality, a gaming device that includes a wireless communications capability, a cellular telephone that includes game and email functions, and a handheld device that receives email, supports mobile telephone calls, and supports web browsing. These are merely illustrative examples.

An illustrative handheld electronic device in accordance with an embodiment of the present invention is shown in FIG. 1. Device 10 may be any suitable portable or handheld electronic device.

Device 10 may have housing 12. Device 10 may include one or more antennas for handling wireless communications. Embodiments of device 10 that contain one antenna and embodiments of device 10 that contain two or more antennas are sometimes described herein as examples.

Device 10 may handle communications over one or more communications bands. For example, in a device 10 with two antennas, a first of the two antennas may be used to handle cellular telephone communications in one or more frequency bands, whereas a second of the two antennas may be used to handle data communications in a separate communications band. With one suitable arrangement, which is sometimes described herein as an example, the second antenna is configured to handle data communications in a communications band centered at 2.4 GHz (e.g., communications frequencies used in wireless networking technologies such as the WIFI® and/or BLUETOOTH® wireless networking technologies).

Housing 12, which is sometimes referred to as a case, may be formed of any suitable materials including, plastic, glass, ceramics, metal, or other suitable materials, or a combination of these materials. In scenarios in which housing 12 is formed from metal elements, one or more of the metal elements may be used as part of the antennas and may be used as part of transmission lines in device 10. For example, metal portions of housing 12 may be shorted to one or more transmission line ground planes. Housing 12 may be shorted to an internal ground plane in device 10 to create a larger ground plane element for that device 10.

Housing 12 may have a bezel 14. The bezel 14 may be formed from a conductive material, if desired. Bezel 14 may serve to hold a display or other device with a planar surface in place on device 10. As shown in FIG. 1, for example, bezel 14 may be used to hold display 16 in place by attaching display 16 to housing 12.

Display 16 may be a liquid crystal diode (LCD) display, an organic light emitting diode (OLED) display, a plasma display, multiple displays that use one or more different display technologies, or any other suitable display. The outermost surface of display 16 may be formed from one or more plastic or glass layers. If desired, touch screen functionality may be integrated into display 16 or may be provided using a separate touch pad device.

Display screen 16 (e.g., a touch screen) is merely one example of an input-output device that may be used with handheld electronic device 10. If desired, handheld electronic device 10 may have other input-output devices. For example, handheld electronic device 10 may have user input control devices such as button 19, and input-output components such as port 20 and one or more input-output jacks (e.g., for audio and/or video). Button 19 may be, for example, a menu button. Port 20 may contain a 30-pin data connector (as an example). Openings 24 and 22 may, if desired, form microphone and speaker ports.

With one suitable arrangement, the antennas of device 10 are located in the lower end 18 of device 10, in the proximity of port 20.

Device 10 may have one or more transmission lines that convey signals between components in device 10. For example, device 10 may have a transmission line 30 coupled between transceiver circuitry 26 and an antenna 28. Transmission line 30 may be, for example, a stripline transmission line, a microstrip transmission line, or any other suitable type of transmission line. Transmission line 30 may convey radio-frequency signals between transceiver 26 and antenna 28.

With one suitable arrangement, transmission line 30 may include a ground plane formed from patterned conductive lines and a conductive paint. As one example, there may be spaces between the conductive lines. The conductive paint may fill the spaces between the conductive lines. The conductive paint may increase the efficiency of the ground plane and thereby increase the transmission efficiency of line 30. Because the conductive lines are patterned with spaces between the conductive lines, the flexibility of transmission line 30 may be improved relative to transmission lines with ground planes formed from a solid line of metal.

Figure 2:
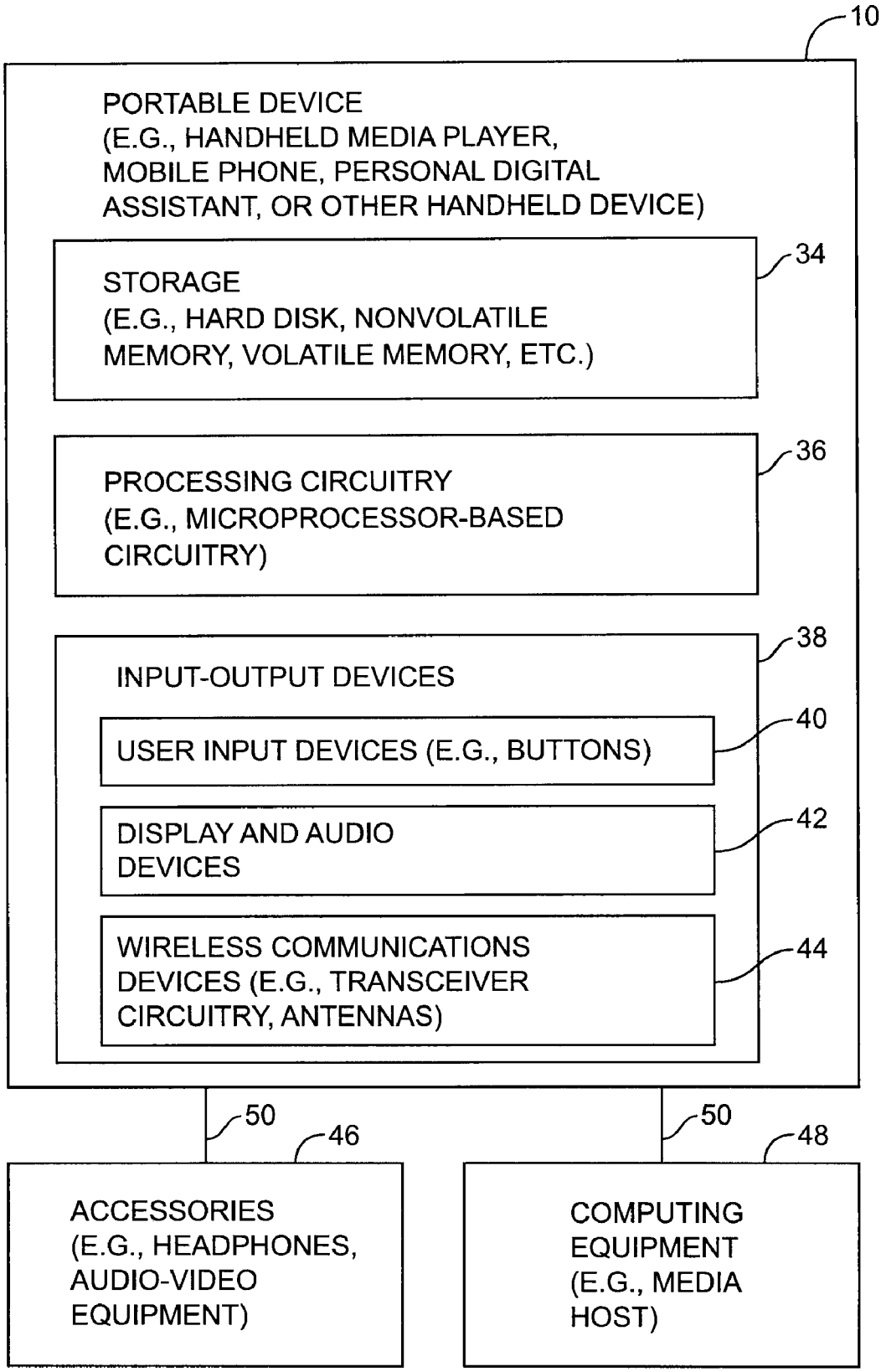
FIG. 2 is a schematic diagram of an illustrative handheld electronic device in accordance with an embodiment of the present invention.

A schematic diagram of an embodiment of an illustrative handheld electronic device is shown in FIG. 2. Handheld device 10 may be a mobile telephone, a mobile telephone with media player capabilities, a handheld computer, a remote control, a game player, a global positioning system (GPS) device, a combination of such devices, or any other suitable portable electronic device.

As shown in FIG. 2, handheld device 10 may include storage 34. Storage 34 may include one or more different types of storage such as hard disk drive storage, nonvolatile memory (e.g., flash memory or other electrically-programmable-read-only memory), volatile memory (e.g., battery-based static or dynamic random-access-memory), etc.

Processing circuitry 36 may be used to control the operation of device 10. Processing circuitry 36 may be based on a processor such as a microprocessor and other suitable integrated circuits.

Input-output devices 38 may be used to allow data to be supplied to device 10 and to allow data to be provided from device 10 to external devices. Display screen 16, button 19, microphone port 24, speaker port 22, and dock connector port 20 of FIG. 1 are examples of input-output devices 38.

Input-output devices 38 can include user input-output devices 40 such as buttons, touch screens, joysticks, click wheels, scrolling wheels, touch pads, key pads, keyboards, microphones, cameras, etc. Display and audio devices 42 may include liquid-crystal display (LCD) screens or other screens, light-emitting diodes (LEDs), and other components that present visual information and status data. Display and audio devices 42 may also include audio equipment such as speakers and other devices for creating sound. Display and audio devices 42 may contain audio-video interface equipment such as jacks and other connectors for external headphones and monitors.

Wireless communications devices 44 may include communications circuitry such as radio-frequency (RF) transceiver circuitry formed from one or more integrated circuits, power amplifier circuitry, passive RF components, transmission lines such as microstrip and stripline transmission lines, one or more antennas, and other circuitry for handling RF wireless signals.

Device 10 can communicate with external devices such as accessories 46 and computing equipment 48 (e.g., a media host), as shown by paths 50. Paths 50 may include wired and wireless paths. Accessories 46 may include headphones (e.g., a wireless cellular headset or audio headphones) and audio-video equipment (e.g., wireless speakers, a game controller, or other equipment that receives and plays audio and video content).

Computing equipment 48 may be any suitable computer. With one suitable arrangement, computing equipment 48 is a computer that has an associated wireless access point (router) or an internal or external wireless card that establishes a wireless connection with device 10. The computer may be a server (e.g., an internet server), a local area network computer with or without internet access, a user's own personal computer, a peer device (e.g., another handheld electronic device 10), or any other suitable computing equipment.

Figure 3:
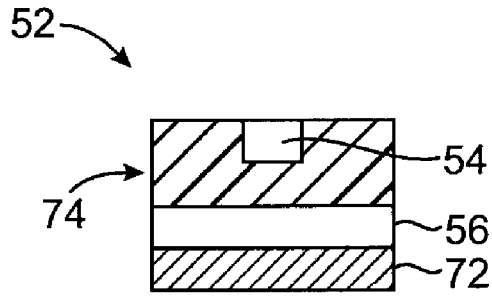
FIG. 3 is a cross-sectional end view of an illustrative microstrip transmission line in accordance with an embodiment of the present invention.

A cross-sectional end view of an illustrative microstrip transmission line 52 is shown in FIG. 3. As shown in FIG. 3, a microstrip 52 includes a strip of conductor 54 sometimes referred to as a trace line or a signal line above a ground plane 56. Conductor 54 and ground plane 56 may be formed using any suitable materials. As one suitable example, conductor 54 and ground plane 56 may be formed from sheets or lines of copper. Ground plane 56 may be a somewhat planar structure, as an example.

Figure 4:
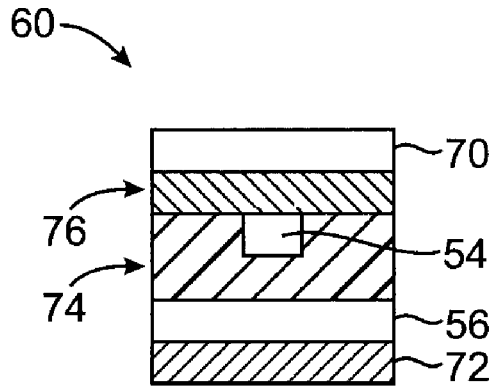
FIG. 4 is a cross-sectional end view of an illustrative stripline transmission line in accordance with an embodiment of the present invention.

FIG. 4 shows a cross-sectional end view of an illustrative stripline transmission line 60. As shown in FIG. 4, stripline 60 includes a strip of conductor 54 sandwiched between two substantially parallel ground planes 56 and 70.

Microstrip 52 and stripline 60 may be fabricated using any suitable technique. With one suitable arrangement, transmission lines such as microstrip 52 and stripline 60 may be formed using a printed circuit board (PCB) technology. For example, stripline 60 may be formed by depositing the lower ground conductor 56 on a non-conductive substrate 72 (e.g., a dielectric substrate). Alternatively, a subtractive method may be used in which the non-conductive substrate 72 is covered by a sheet of conductor material and the lower ground conductor 56 is formed by etching away the portions of the sheet of conductor material that do not correspond to the lower conductor 56.

After forming the lower conductor 56, a dielectric layer 74 may be deposited over the lower conductor 56 and conductor 54 may be formed in, or over, the dielectric layer 74. As described above in connection with the lower ground conductor 56, signal conductor 54 may be formed using any suitable method such as an additive method or a subtractive method. In the additive method, conductive material is deposited onto layer 74 along the length of the transmission line to form conductor 56. In the subtractive method, conductive material is first deposited as a sheet over the surface of the dielectric 74. Subsequently, the conductive material that does not correspond to conductor 54 is etched away using a patterned etching process. With another suitable arrangement, conductor 54 may be formed by etching a trench into dielectric 74 and filling the trench with conductive material.

Once conductor 56 is formed, another dielectric layer 76 may be deposited as shown in FIG. 4. The upper ground conductor 70 (e.g., the upper ground conductor 70 shown in FIGS. 4 and 5) may formed over or within dielectric layer 76. As with the lower ground conductor 56 and the signal conductor 54 described above, the upper ground conductor 70 may be formed using any suitable technique.

If desired, substrate and dielectric material in transmission lines such as lines 52 and 60 may extend beyond the dimensions of the transmission lines. For example, substrate 72 and dielectric layers 74 and 76 may be somewhat wider than conductors 56, 54, and 70. If desired, dielectric layers 74 and 76 may extend widthwise beyond the dimensions of vias 58 of FIG. 5.

The substrate and the dielectric layers in the circuit board forming transmission lines 52 and 60 may be formed using any suitable materials. For example, the substrate and the dielectric layers in microstrip 52 and stripline 60 may be formed from polytetrafluoroethylene (PTFE), FR-2 (phenolic cotton paper), FR-3 (cotton paper and epoxy), FR-4 (woven glass and epoxy), FR-5 (woven glass and epoxy), FR-6 (matte glass and polyester), G-10 (woven glass and epoxy), CEM-1 (cotton paper and epoxy), CEM-2 (cotton paper and epoxy), CEM-3 (woven glass and epoxy), CEM-4 (woven glass and epoxy), CEM-5 (woven glass and polyester), paper impregnated with phonolic resin, resins reinforced with glass fibers such as fiberglass mat impregnated with epoxy resin (sometimes referred to as FR-4), plastics, polystyrene, polyimide, ceramics, or any other suitable material. Circuit boards with substrate and dielectric materials fabricated from materials such as FR-4 are commonly available, are not cost-prohibitive, and can be fabricated with multiple layers of metal (e.g., three layers). So-called flex circuits, which are flexible circuit board materials such as polyimide, may also be used in device 10. By using flex circuits, a manufacturer can increase the flexibility of the substrate and the dielectric layers in transmission lines such as lines 30, 52, and 60.

Figure 5:
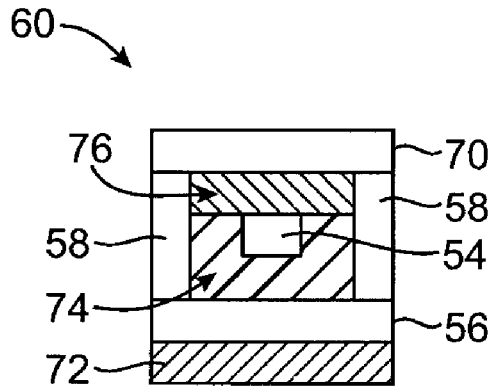
FIG. 5 is a cross-sectional end view of an illustrative stripline transmission line that has vias that electrically couple together a first and a second ground conductor in accordance with an embodiment of the present invention.

If desired, stripline 60 may include a plurality of vias 58 that connect ground planes 56 and 70 together. For example, as shown in FIG. 5, stripline 60 may include vias 58 on each side of conductor 54 that electrically connect the top and bottom ground planes 56 and 70 together. While FIG. 5 only shows a cross-sectional end view of vias 58, stripline 60 may include multiple vias 58 at suitable positions along the length of stripline 60. For example, vias may be placed at regular intervals along the length stripline 60, near bends in stripline 60, at regular intervals along the length of stripline 60 except near bends in stripline 60, near the end of stripline 60 (e.g., near connectors connected to stripline 60), and at any other suitable locations. As shown in FIG. 5, stripline 60 may include dielectric layer 72.

Vias such as vias 58 may be formed at any suitable time during the fabrication of a transmission line. For example, vias 58 may be formed after the dielectric layer 74 above conductor 54 is deposited. With another suitable arrangement, a lower half of vias 58 may be formed after the dielectric layer 74 above the lower conductor 56 is formed and an upper half of vias 58 may be formed after the dielectric layer 76 above conductor 54 is deposited.

Figure 6:
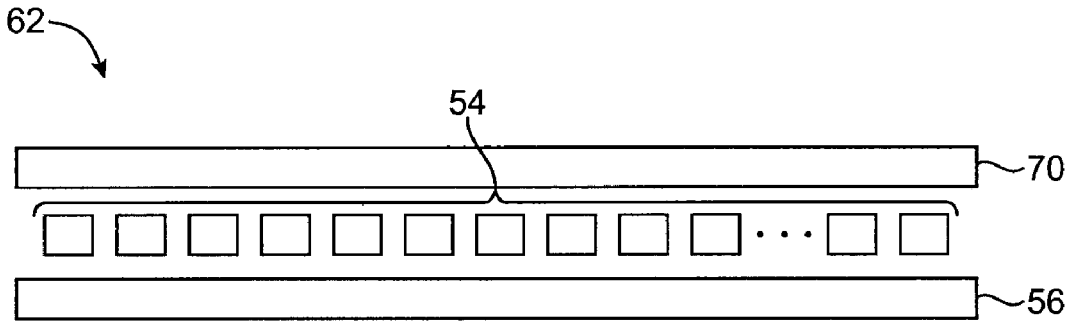
FIG. 6 is a cross-sectional end view of an illustrative stripline transmission line that includes multiple signal lines in accordance with an embodiment of the present invention.

As shown in FIG. 6, transmission lines such as lines 52 (FIG. 3) and 60 (FIGS. 4 and 5) may include multiple transmission lines (e.g., microstrip 52 and stripline 60 may include multiple signal lines). The transmission lines may include multiple signals lines arranged side-by-side, as an example. In general, a transmission line such as microstrip line 62 may include any suitable number of signal conductors 54 as well as any suitable number of ground planes 56 and 70.

Figure 7:
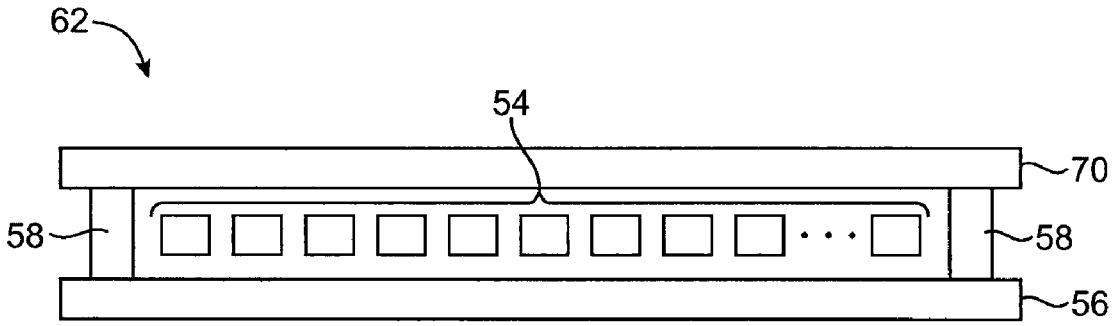
FIG. 7 is a cross-sectional end view of an illustrative stripline transmission line that includes multiple signal lines and that may include vias along the sides of the transmission line in accordance with an embodiment of the present invention.

If desired, transmission lines that include multiple signals lines may also include one or more vias 58. For example, as shown in FIG. 7, transmission line 62 may include vias 58 along each side of the transmission line 62. Vias 58 may serve to extend the ground plane of line 62 formed by ground plane conductors 56 around the sides of the transmission line 62. As shown in FIG. 7, transmission line 62 may include conductor 70.

Figure 8:
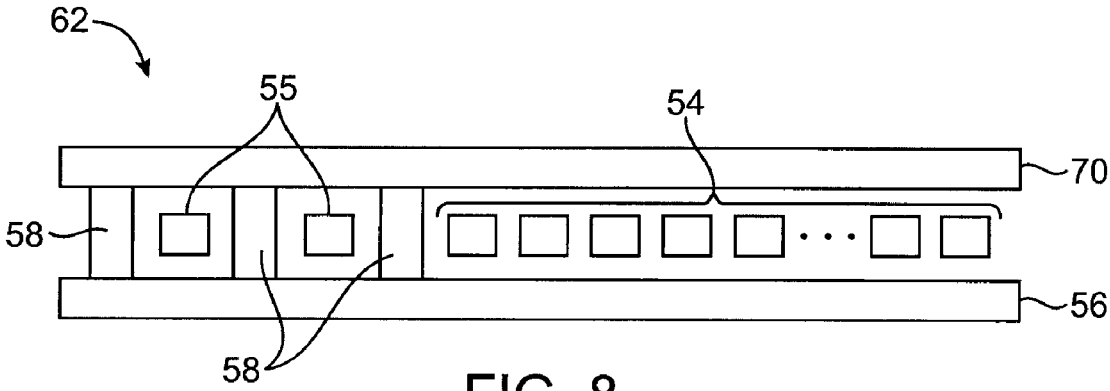
FIG. 8 is a cross-sectional end view of an illustrative stripline transmission line that includes multiple signal lines and that may include vias between at least some of the signals lines in accordance with an embodiment of the present invention.

FIG. 8 shows one potential arrangement for transmission line 62. In the arrangement shown in FIG. 8, transmission line 62 may include one or more vias that are between some of the signal lines that make up the line 62. In the example of FIG. 8, there may be vias on either side of signal lines 55. The arrangement shown in FIG. 8 may be particularly useful when, as an example, signal lines 55 carry relatively high power signals and/or when a manufacturer wants to ensure that radio-frequency signals carried on signal lines 55 are not degraded (e.g., the manufacturer desires to minimize interference and maximize the transmission efficiency of signal lines 55 relative to signal lines 54). As shown in FIG. 8, transmission line 62 may include conductors 56 and 70.

Figure 9:
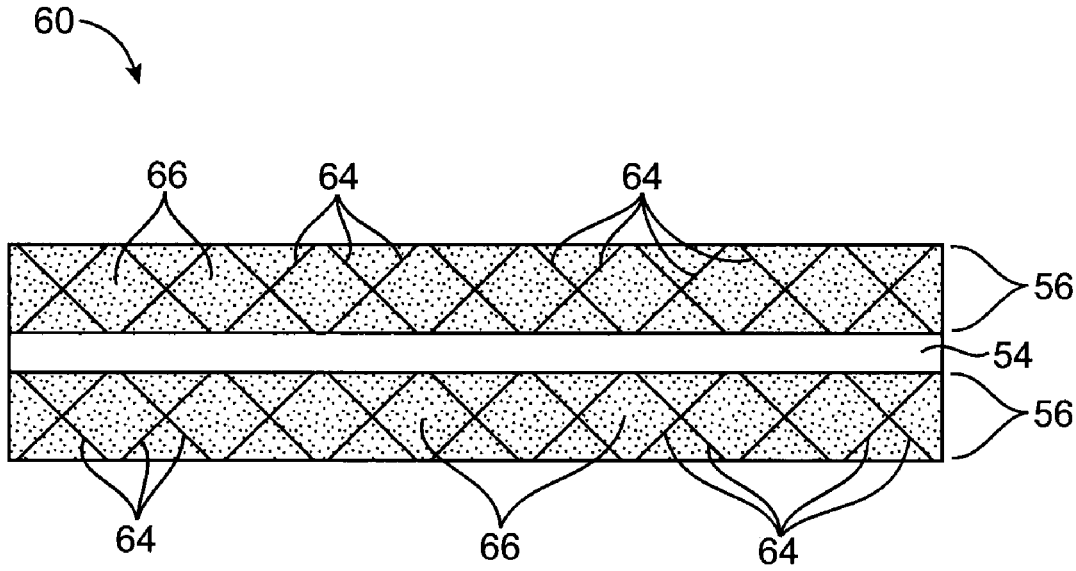
FIG. 9 is a cross-sectional top view of an illustrative stripline transmission line that includes patterned conductive lines with spaces between the conductive lines and conductive paint in the spaces between the conductive lines in accordance with an embodiment of the present invention.

As shown in FIG. 9, a transmission line such as transmission line 52 (FIG. 3), 60 (FIGS. 4 and 5), or 62 (FIGS. 6, 7, and 8) may include one or more planar ground conductors formed from patterned conductive lines with spaces between the lines and a conductive paint or conductive film that electrically bridges the spaces. For example, the cross-sectional top view shown in FIG. 9 illustrates how a signal conductor 54 may run over a lower ground conductor 56 separated by a dielectric (not shown in FIG. 9).

The ground conductor 56 may include conductive lines 64. The conductive lines 64 may be patterned and there may be spaces between the conductive lines 64. With one suitable arrangement, the conductive lines 64 may be arranged in a crosshatched pattern (e.g., the pattern shown in FIG. 9). In general, conductive lines 64 may be formed in any suitable pattern. For example, conductive lines 64 may be a plurality of parallel conductive lines that are aligned along the length of line 60, across the width of line 60, or at any suitable angle to the lengthwise dimension of line 60 (e.g., the direction in which signals travel along signal line 54). If desired, conductive lines 64 may be arranged randomly while leaving at least some spaces which are not covered by conductive lines 64.

Figure 10:
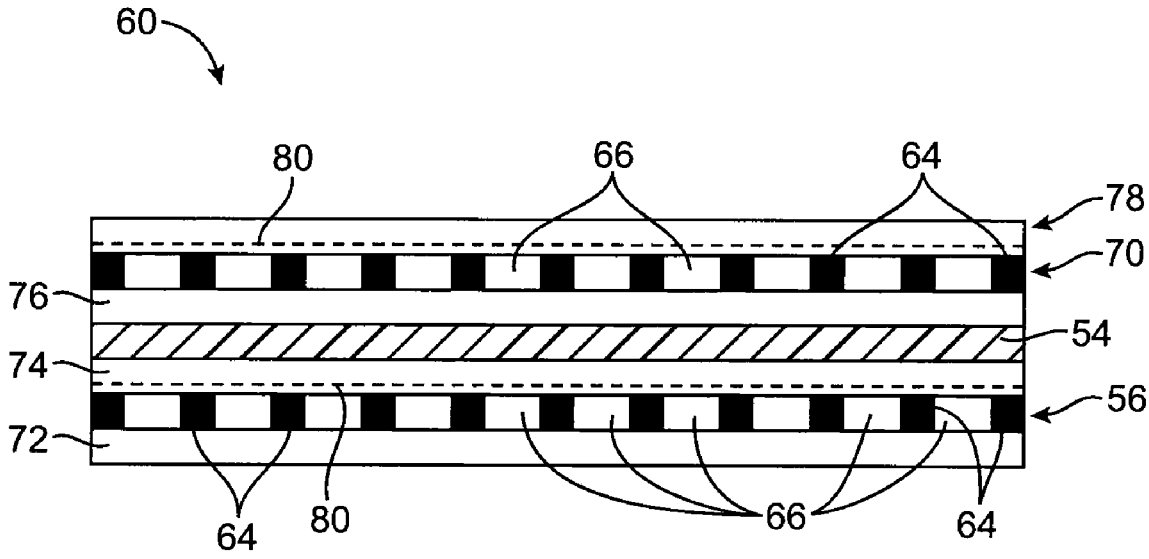
FIG. 10 is a cross-sectional side view of the illustrative stripline transmission line of FIG. 9 in accordance with an embodiment of the present invention.

Ground conductor 56 may also include a conductive film 80 (shown as dotted lines in FIG. 10) or a conductive paint 66. As one example, the conductive paint 66 may be applied to the spaces between the conductive lines 64 (e.g., the shaded areas of FIG. 9). If desired, the conductive paint 66 may be selectively applied in specific regions of ground conductor 56. With one suitable arrangement, the conductive paint 66 may be applied over the conductive lines and the spaces between the conductive lines. If desired, the conductive paint 66 may be applied to substrate 72 and to dielectric 76 before conductive lines such as lines 64 are formed (e.g., the conductive paint may be below the conductive lines 64) as shown in FIG. 10. Conductive paint 66 may be applied below and above the conductive lines such that the conductive paint surrounds the conductive lines 66, as an example. Conductive paint 66 may be applied using any suitable technique. For example, conductive paint 66 may be applied using a screen printing technique and conductive paint 66 may be applied by a squeegee technique in which a liquid form of the paint 66 is spread in one or more locations and a mechanical pressure is used to spread the paint 66 across the spaces between conductive lines 64.

A side view of the stripline 60 shown in FIG. 9 is illustrated by FIG. 10. As shown in FIG. 10, transmission line 60 may be formed with a first dielectric layer 72 (e.g., a substrate), a lower ground conductor layer 56, a first optional conductive film layer 80, a second dielectric layer 74, a signal conductor layer 54, a third dielectric layer 76, an upper ground conductor layer 70, a second optional conductive film layer 80, and an optional fourth dielectric layer 78 (e.g., a layer that covers transmission line 60). This is merely one example and, in general, transmission line 60 may be formed using any suitable number of layers, any suitable arrangement of layers, and any suitable types of layers.

As shown in FIG. 10, there may be spaces between the conductive lines 64. The conductive lines 64 are illustrated by the shaded portions in conductors 56 and 70 of FIG. 10. The spaces between conductive lines 64 are illustrated by the un-shaded portions of conductors 56 and 70. Conductive paint 66 may be applied in the spaces to electrically bridge the spaces (e.g., to electrically couple together conductive lines 64 across the spaces between the conductive lines). Alternatively or in addition to the conductive paint 66, a conductive film 80 may be applied above and/or below conductors 56 and 70. The conductive film may help to electrically bridge the spaces between the conductive lines.

Figure 11:
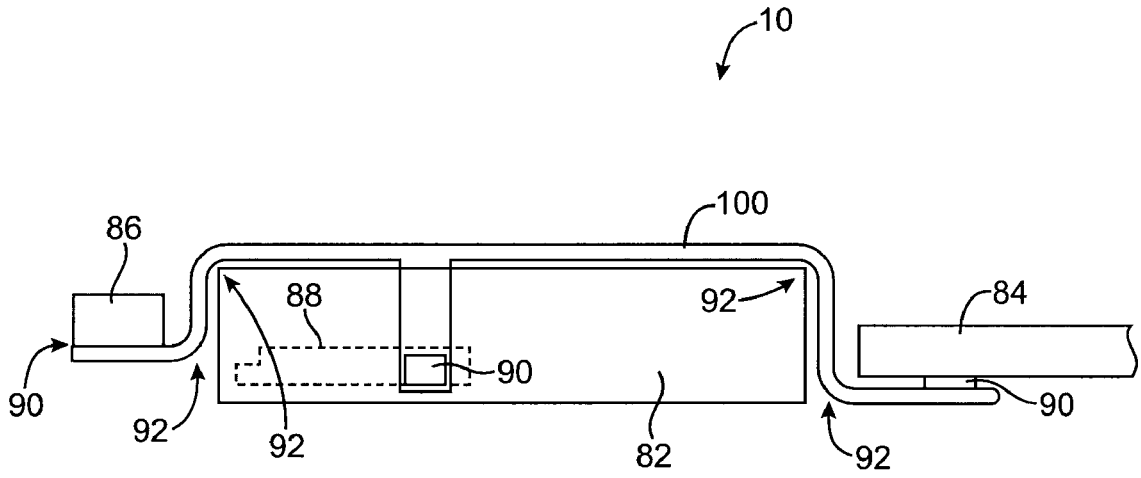
FIG. 11 is a side view of an illustrative electronic device that may include a flexible transmission line with a hybrid ground plane that may be formed from crosshatched ground conductors and a conductive paint in accordance with an embodiment of the present invention.
Figure 12:
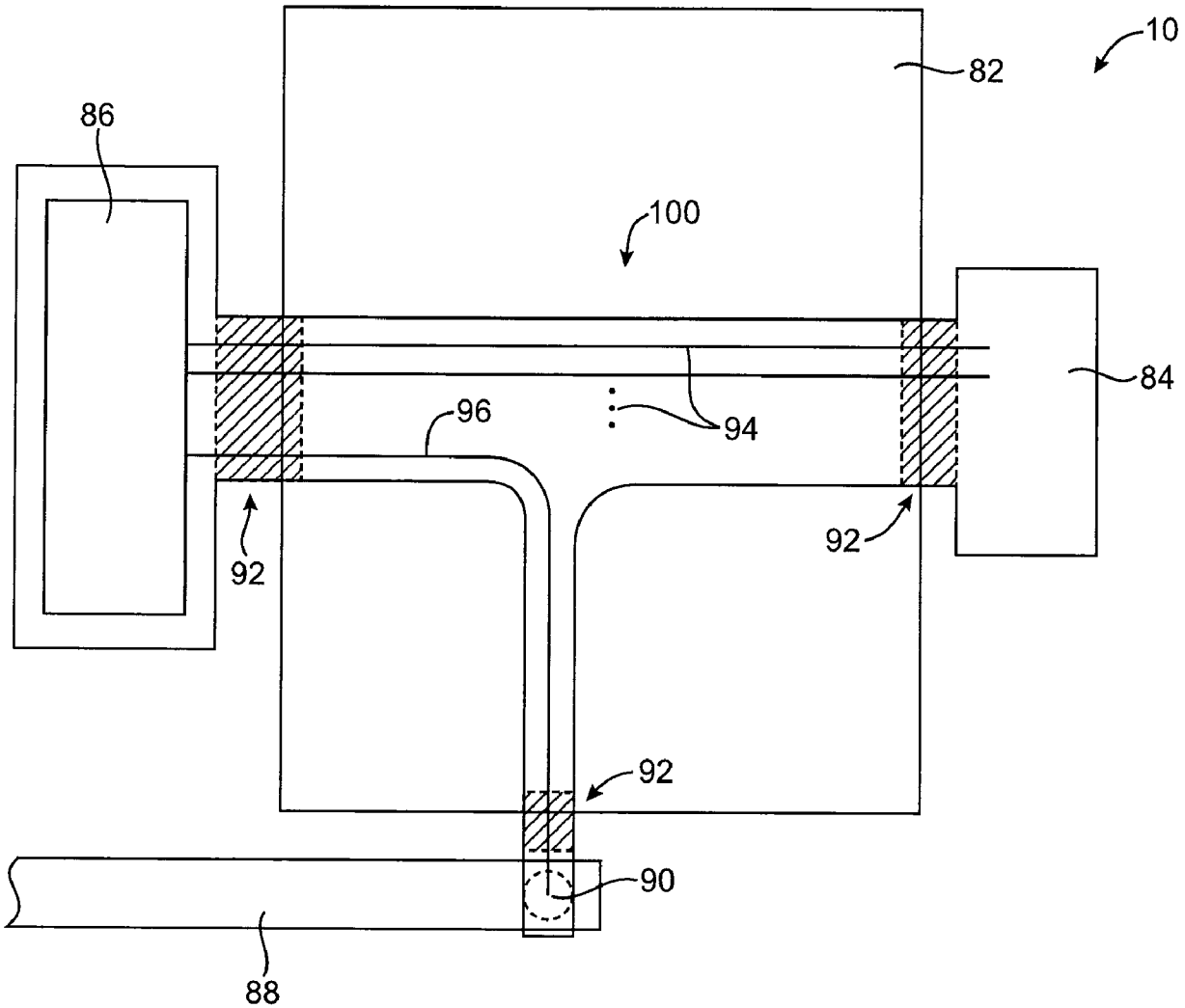
FIG. 12 is a top view of the illustrative electronic device and the flexible transmission line shown in FIG. 11 in accordance with an embodiment of the present invention.

FIGS. 11 and 12 illustrate one potential way in which a transmission line 100 (e.g., a transmission line 52 (FIG. 3), 60 (FIGS. 4 and 5), or 62 (FIGS. 6, 7, and 8)) may be routed through the geometry of an electronic device 10. In the example of FIGS. 11 and 12, transmission line 100 may be routed around a first component 82 and line 100 may be coupled between a second component 84, a third component 86, and a fourth component 88. Signal lines and ground conductors may be coupled to components 84, 86, and 88 at connectors 90. As one example, components 82, 84, 86, and 88 may be a battery, a motherboard, a radio-frequency transceiver, and an antenna, respectively.

As illustrated by arrows 92 in FIGS. 11 and 12 and by the shaded regions in FIG. 12, there may be regions of transmission line 100 that are bent relatively sharply (e.g., there may be at least one portion of transmission line 100 that bends around an edge of a component such as component 82, 84, 86, and 88 and that has a bend radius that is less than or equal to 1.0 mm). With one suitable arrangement, transmission line 100 may be bent at an angle of approximately 90° in each of the regions 92. If desired, transmission line 100 may have ground conductors formed from conductive lines with spaces and conductive paint in the spaces in the shaded regions (e.g., regions 92) of FIG. 12 and may have ground conductors that are formed from a solid line of conductive material in the un-shaded regions.

As shown in FIG. 12, transmission line 100 may include signal lines 94 that convey signals between components 84 and 86 and may include one or more signal lines 96 that convey signals between components 86 and 88. With one suitable arrangement, signal lines 94 may convey data signals between motherboard 84 and transceiver 86 and signal lines 96 may convey radio-frequency signals that are to be transmitted to antenna 88 from transceiver 86 or that have been received by antenna 88 from antenna 88 to transceiver 86.

The foregoing is merely illustrative of the principles of this invention and various modifications can be made by those skilled in the art without departing from the scope and spirit of the invention.

What is claimed is:

1. A method of forming a transmission line, comprising:
forming a transmission line signal conductor; and
forming a transmission line planar ground conductor that is separated from the transmission line signal conductor by a dielectric, wherein forming the transmission line planar ground conductor comprises:
forming a conductor having a pattern of openings; and
depositing conductive paint in the openings, wherein forming the conductor having the pattern of openings comprises forming cross-hatched conductive lines, wherein at least one portion of the transmission line bends around an edge of a component of an electronic device and has a bend radius that is less than or equal to 1.5 mm and wherein forming the transmission line planar ground conductor further comprises depositing the conductive paint on the conductor that has the pattern of openings.

2. The method defined in claim 1 wherein depositing the conductive paint in the openings comprises depositing a silver paint in the openings.

3. The method defined in claim 1 wherein forming the cross-hatched conductive lines comprises forming cross-hatched copper lines.

4. A transmission line in an electronic device, comprising:
a dielectric;
a signal conductor; and
a planar ground conductor separated from the signal conductor by the dielectric, wherein the planar ground conductor comprises conductive lines arranged in a pattern with spaces between the conductive lines and comprises a conductive paint in the spaces between the conductive lines, wherein the conductive lines comprise crosshatched metal lines, wherein the transmission line has two sections each of which has a length, wherein a first section of the two sections comprises the crosshatched metal lines and the conductive paint, wherein the crosshatched metal lines and the conductive paint extend along the length of the first section, wherein a second section of the two sections comprises a second planar ground conductor formed from a solid metal line that extends along the length of the second section, and wherein the crosshatched metal lines and the conductive paint are electrically coupled to the solid metal line.

5. The transmission line defined in claim 4 wherein the conductive lines comprise crosshatched copper lines.

6. The transmission line defined in claim 4 wherein the conductive paint comprises silver paint.

7. A transmission line in an electronic device, comprising:

a dielectric;

a signal conductor; and a planar ground conductor separated from the signal conductor by the dielectric, wherein the planar ground conductor comprises conductive lines arranged in a pattern with spaces between the conductive lines and comprises a conductive foil that covers the conductive lines and the spaces.

8. The transmission line defined in claim 7 wherein the conductive foil comprises metal foil.

9. The transmission line defined in claim 7 further comprising:

an additional planar ground conductor, wherein the signal conductor and the dielectric are sandwiched between the planar ground conductor and the additional planar ground conductor.

10. The transmission line defined in claim 9 wherein the additional planar ground conductor comprises additional conductive lines arranged in a pattern with spaces between the additional conductive lines and an additional conductive foil that covers the additional conductive lines and the spaces between the additional conductive lines.

11. The transmission line defined in claim 9 further comprising:

a plurality of vias that electrically connect the planar ground conductor and the additional planar ground conductor.

12. An electronic device comprising:

a radio-frequency transceiver;

a component;

an antenna; and a transmission line coupled between the radio-frequency transceiver and the antenna, wherein the transmission line comprises:

a dielectric;

a signal conductor;

a planar ground conductor that is separated from the signal conductor by the dielectric, wherein the planar ground conductor has patterned portions that define openings; and a conductive paint in the openings, wherein at least one portion of the transmission line bends around an edge of the component and has a bend radius that is less than or equal to 1.0 mm.

13. The electronic device defined in claim 12 wherein the component is a battery.

14. The electronic device defined in claim 12 wherein the transmission line has at least two sections each of which has a length, wherein a first section of the at least two sections comprises the conductive lines and the conductive paint, wherein the conductive lines and the conductive paint extend along the length of the first section, wherein a second section of the at least two sections comprises a second planar ground conductor formed from a solid metal line that extends along the length of the second section, and wherein the conductive lines and the conductive paint are electrically coupled to the solid metal line.

15. The electronic device defined in claim 14 wherein the second section comprises a portion of the transmission line that runs along a flat surface of the component.

16. The electronic device defined in claim 14 wherein the first section comprises the at least one portion of the transmission line that bends around the edge of the component.

17. A transmission line in an electronic device, comprising:

a dielectric;

a signal conductor; and a planar ground conductor separated from the signal conductor by the dielectric, wherein the planar ground conductor comprises conductive lines arranged in a pattern with spaces between the conductive lines and comprises a conductive paint in the spaces between the conductive lines, wherein the transmission line has two sections each of which has a length, wherein a first section of the two sections comprises the conductive lines and the conductive paint, wherein the conductive lines and the conductive paint extend along the length of the first section, wherein a second section of the two sections comprises a second planar ground conductor formed from a solid metal line that extends along the length of the second section, and wherein the conductive lines and the conductive paint are electrically coupled to the solid metal line.

18. The transmission line defined in claim 17 wherein the conductive paint comprises silver paint.

* * * * *